United States Patent [19]

Pfleiderer et al.

[11] Patent Number: 4,484,924

[45] Date of Patent: Nov. 27, 1984

[54] PROCESS FOR PRODUCING UNHAIRED, STORABLE HIDES AND SKINS

[75] Inventors: Ernst Pfleiderer, Darmstadt-Arheilgen; Tilman Taeger, Griesheim; Rolf Monsheimer, Darmstadt-Eberstadt, all of Fed. Rep. of Germany

[73] Assignee: Röhm GmbH, Darmstadt, Fed. Rep. of Germany

[21] Appl. No.: 505,782

[22] Filed: Jun. 20, 1983

[30] Foreign Application Priority Data

Jul. 3, 1982 [DE] Fed. Rep. of Germany ..... 3224881

[51] Int. Cl.[3] ..... C14C 1/06; C14C 1/08

[52] U.S. Cl. ..... 8/94.17; 8/94.15

[58] Field of Search ..... 8/94.15, 94.17

[56] References Cited

U.S. PATENT DOCUMENTS

| | | | |
|---|---|---|---|
| 1,969,922 | 8/1934 | Canter | 8/94.15 |
| 2,937,921 | 5/1960 | Cordon et al. | 8/94.15 |
| 3,741,722 | 6/1973 | Elvrum | 8/94.17 |
| 4,229,175 | 10/1980 | Knaflic et al. | 8/94.16 |
| 4,278,432 | 7/1981 | Monsheimer et al. | 8/94.16 |
| 4,351,639 | 9/1982 | Monsheimer et al. | 8/94.16 |

OTHER PUBLICATIONS

Kirk-Othmer, Encyclopedia of Chemical Technology, Interscience Encyclopedia, Inc., New York, vol. 8, pp. 291-295.

*Primary Examiner*—Maria Parrish Tungol

*Attorney, Agent, or Firm*—Curtis, Morris & Safford

[57] ABSTRACT

What is disclosed is a process for the unhairing and subsequent curing of hides and skins, which comprises washing flayed skins and hides to remove adhering dirt, then soaking said skins and hides and freeing them of hair and scud with a short term unhairing, reversing the swelling of said skins and hides and neutralizing them, and curing said skins and hides with salt, said skins and hides being mechanically fleshed either after washing or at some later time in the process as recited.

14 Claims, No Drawings

PROCESS FOR PRODUCING UNHAIRED, STORABLE HIDES AND SKINS

The present invention relates to a process for the unhairing and subsequent curing of hides and skins.

To prepare pelts for tanning, the hair, the epidermis and the subcutaneous connective tissue must be removed therefrom by chemical and mechanical means. The operations to which the prefleshed hides are then subjected depend on whether the hair is to be destroyed or preserved. The use of hair destroying methods requires less labor and usually results in leather of a better quality with a denser fiber structure. However, the pollution of waste waters with protein hydrolyzates and other chemicals must be regarded as a serious drawback.

The destruction of keratinous material such as hair, bristles, etc., is mostly brought about with inorganic sulfides and alkali. The alkali metal sulfide cleaves the disulfide links of the keratin molecules and thereby dissolves not only the hair substance but also the epidermis.

When conventional unhairing methods are used, the dissolved keratin of the hair, bristles, or wool, and of the epidermis, passes into the waste water. The result is high protein loading of the waste water, which in the case of lime liquors can produce COD (chemical oxygen demand) values ranging from 15,000 to 20,000 mg of $O_2$/liter. The sulfide content of the lime liquors is also increased by the sulfur content of the keratin so that sulfide contents as high as 2,000 mg of S/liter are observed.

The waste water pollution problem has prompted leather research institutes and the industry to search intensively for new solutions. One tangible result of these efforts is the development of new intermediate products. Mention should be made in this connection of "wet blues" and crust leather. However, while these intermediate products still permit some modification of the properties of the leather by retannage, fat liquoring or finishing, basic changes with respect to softness, handle, fineness of grain, freedom from scud, etc., are no longer possible except at the expense of a significant loss in other quality characteristics, such as drawn or loose grain, or grain damage.

An enzymatic process for the preservation of hair and the simultaneous opening of the hide structure is known from German patent publication No. 29 17 376 wherein a hide which has been freed of curing salt is first given an acid pretreatment with substances cleaving disulfide links, following which the loosening of the hair and the opening of the hide structure are effected simultaneously at a pH value of about 11 to 13, without prior soaking, by the use of proteases active in the alkaline region.

In the so-called "Darmstadt continuous process", hides are sprayed on the hair side with a highly concentrated sodium sulfide solution in a special apparatus after they have been washed. After about 20 minutes, the hair and epidermis are stripped, conveyed to a reactor, and there neutralized. The curing of the hides themselves is effected with a 12% sodium chlorite solution in the pH range from 8 to 12. [See "Das Leder" 28 (10), 166–169 (1977) and published German patent application DOS No. 2,726,576.]

Experience has shown that the opening of the hide structure continues in the alkaline region, with the result that the longer the hides are then stored, the poorer will be the quality of the leather obtained.

A number of special methods for the curing of hides and skins have recently been proposed. For example, the preservation of raw hides and skins by treatment with formaldehyde is recommended in J. Soc. Leather Technol.Chem. 62, (1978) and treatment with a mercurous chloride solution in Leather Sci. (Madras), 21, 297–304 (1974) (see also Chem. Abstr. 82, 100095w). From the journal Kozarstvi 28 (11), 323–325 (1978) (Chem. Abstr. 90, 139077g), the curing of enzymatically unhaired sheepskin pelts with benzothiazole derivatives and thioalkyl halides or dithiocarbamate derivatives is known.

The present invention has as its object to provide unhaired hides and skins which can be conventionally cured with common salt. Following curing, the loosening of the hide structure can be carried out by liming after a brief soak.

With the intermediate products introduced up to now, afterliming is not possible without additional operations, such as detanning and depickling.

The object of the invention is accomplished by a process which can be broken down into the following steps:

(a) Washing or soaking for the removal of dirt;
(b) optional fleshing (which can also be done later, e.g. after soaking, unhairing, or curing);
(c) soaking;
(d) short-term unhairing;
(e) deswelling and neutralization (deliming); and
(f) curing with common salt.

Washing operations may be carried out between the various steps.

The process of the invention is suited for use with both freshly flayed hides and skins and stock that has already been salted. The washing step (a) serves for the removal of dirt such as dung, manure, blood, etc.

Washing can be done conventionally, for example with from 50 to 120 percent water, in a mixer or in a drum, preferably at a temperature somewhat higher than room temperature, for example at about 25° to 28° C. With freshly flayed stock, a wash of less than 30 minutes, and usually about 15 minutes, usually will suffice. With salted stock, a soak to remove dirt is advisable, which generally takes a little longer, a guide value being about 1 hour.

After the liquor has been drained, fleshing can follow, although it may also be done in a subsequent step. The fleshing step (b) is carried out conventionally, for example mechanically. Wetting of the grain is desirable.

In the soaking step (c), soaking chemicals such as conventional surface active wetting agents, for example ethoxylated octyl or nonyl phenols, are advantageously used. Soaking may be carried out in a mixer or, in the case of salted pelts, for example, in a drum. The temperature of the liquor is advantageously also somewhat above room temperature, for example 25° to 28° C. The wetting agents are generally used in amounts ranging from 0.2 to 0.5 percent by weight of the hides or skins being treated.

The pH value of the soak liquor generally ranges from 7 to 11, and preferably from 8 to 10. Advantageously, chemicals are employed as soaking aids which, when added to the liquor in amounts of from 0.1 to 0.5 percent by weight of the hides or skins being treated, give a pH value between 7 and 11. Examples of such chemicals are common salt as well as alkalinizing agents such as alkalis, sodium or potassium carbonate and bicarbonate, and other alkali metal salts of weak acids.

Proteolytic enzymes whose optimum activity is in the pH range from 9 to 11 are advantageously also used in soaking. As a rule, float lengths up to 150 percent of the weight of the hides or skins being treated will suffice in soaking. The duration of the soak generally will not be longer than 120 minutes and usually ranges from 30 to 120 minutes. The float then is usually drained.

The unhairing step (d) is also of short duration. As a rule, from ½ to 6 hours will suffice, although a duration of from 1 to 4 hours is preferred. This step is advantageously carried out by drum unhairing. Short term unhairing is generally done in the alkaline pH range, preferably at a pH ranging from 10 to 13. Alkalinization can be carried out conventionally, for example by means of alkali and in the presence of hydrated lime. The use of proteolytic enzymes whose optimum activity is in the alkaline pH region is advantageous.

Performing the short term unhairing step with the aforementioned means by the drum unhairing method, for example, permits complete hair removal without appreciable dissolution of the keratin. After the short term treatment, the hair, wool, or bristles can be removed from the effluent by screening, for example, which is not possible when inorganic sulfides are used in combination with alkalies (hydrated lime/caustic soda) alone. Unhairing usually is followed by another wash, for example, with 100 percent of water.

The process of the invention makes it possible to dispense with the use of inorganic sulfides. However, unhairing may also be carried out conventionally in combination with inorganic sulfides, or with inorganic sulfides alone. However, with a large amount of sulfides the keratin decomposition products are difficult to separate.

When sulfide free reducing agents are concurrently used, the proportion of inorganic sulfide should not exceed 50 weight percent, based on the total amount of the reducing agents.

Preferably, organic agents which cleave disulfide links are used in the short term unhairing step. These agents preferably have the formula $$R—SH,$$

wherein R is alkyl, and in particular alkyl having 2 or 3 carbon atoms, the carbon atoms being optionally substituted by a thiol or hydroxy group; or is $—(CH_2)_n(CHR_1)—COOH$ wherein $R_1$ is hydrogen, alkyl having from 1 to 6 carbon atoms, or amino, and n is an integer from 0 to 6; or is an $R_2CO$ group, $R_2$ being alkyl having from 1 to 6 carbon atoms or phenyl. The agent may also be of the formula $$R'—\underset{\underset{NH_2}{|}}{C}=S,$$

wherein R' is hydrogen, alkyl having from 1 to 6 carbon atoms, or amino.

In particular, thioglycolic acid, thioacetic acid, and mercaptoethanol are suitable for use. Other suitable substances are propanethiol, alpha-thioglycerol, 1,2-dithioglycerol, 1,4-dithioerythrol, thiolactic acid, mercaptopropionic acid, beta-thioloctanoic acid, thiosalicylic acid, thiobenzoic acid, cysteine, mercaptoglycine, thioacetamide and thiourea. A combination of urea, thioglycolic acid, and mercaptoethanol, for example in the approximate ratio of 1:1:3 weight percent, is advantageous.

Other nitrogen-containing auxiliary chemicals suitable for use in short term unhairing are alkylated amines of the formula $$R_3—\underset{\underset{R_4}{|}}{NH},$$

wherein $R_3$ and $R_4$ are alkyl, optionally substituted by hydroxyl, having from 1 to 3 carbon atoms, and amides of the formula $$R''—\underset{\underset{NH_2}{|}}{C}=O,$$

wherein R'' has the same meanings as R'. These compounds may be used in the form of their salts, if desired. When properly used, the disulfide link-cleaving agents will not liberate inorganic sulfide in amounts that might interfere with the course of the process.

As a rule, the aforementioned four classes of auxiliary chemicals which cleave disulfide links (and which may be used individually or in combination) are employed in amounts ranging from 0.3 to 10 percent, and preferably from 5.0 to 8.0 percent, by weight of the hides and skins being treated.

Proteolytic enzymes may be used to advantage both in the soaking step (c) and in the unhairing step (d). The proteases used in soaking are active in the alkaline region and possess appropriate stability. Preferably they are optimally active above pH 8.5, and more particularly in the pH range from 9 to 11. Proteases of both animal and microbiological origin, and especially bacterial proteases, are suitable for use.

Particularly suitable are serine proteases, that is the group of animal and bacterial endopeptidases which have a catalytically active serine group in the active center (see Lexikon Biochemie, Verlag Chemie, Weinheim, 1976, pp. 512–513), and especially serine proteases of bacterial origin.

Examples are, in particular, the proteases of such bacilli as *B. subtilis, B. licheniformis, B. firmus, B. alcalophilus, B. polymixa,* and *B. mesenthericus.*

As a guide, the enzyme activity may range from 8,000 to 10,000 Loehlein-Volhard units (LVU) per gram of enzyme.

In the soaking step in accordance with the invention, the proteases active in the alkaline region are generally used in amounts ranging from 0.1 to 1.0 percent, and preferably from 0.3 to 1.0 percent, by weight of the hides and skins being treated.

In the process of the present invention, additives commonly used with enzymes, such as activators, stabilizers, etc., may also be used. What has been said in connection with proteases suitable for use in soaking (see above) essentially applies also to proteases suitable for use in short term unhairing. When the latter step is carried out as an essentially enzymatic process, the treating time usually ranges from 6 to 8 hours.

Fleshing for removal of the subcutaneous connective tissue can be carried out at different times, for example after soaking with enzyme treatment for wetting of the grain, after unhairing, after curing, or following afterliming for the manufacture of leather.

When fleshing is done prior to unhairing with the auxiliary chemicals mentioned above, the fleshings obtained can be used as animal feed.

Following removal of the hair, it is advisable to stop the opening of the hide structure by deswelling and deliming, the purpose being to remove the alkali bound by the hide and through neutralization, to reverse the swelling produced. [Step (e).]

Deswelling is best done with water (about 100 percent), which advantageously contains salts having buffer action in the acid region, either alone or in combination with acids suitable for use in deliming, advantageously with agitation. For example, the commonly used deliming acids and/or ammonium salts such as ammonium sulfate, in combination with sodium hydrosulfite or with adipic acid, citric acid, propionic acid, and the like are suitable. [See F. Stather in "Gerbereichemie und Gerbereitechnologie" ("Tanning Chemistry and Tanning Technology"), Akademie-Verlag, Berlin, 4th ed., 1967, p. 211.]The content of deliming acids and/or of ammonium salts usually ranges from 2.0 to 4.0 percent, a guide value being about 2.5 percent, by weight of the hides and skins being treated.

The hides or skins can be conventionally sectioned and the section coated with a 1% alkaline solution of phenolphthalein. (Color change to red at pH 8.9 to 9.8.) Delimed hides or skins should not turn red when coated with phenolphthalein. (See F. Stather, loc. cit., p. 217.) The hides or skins are then advantageously placed on horses and allowed to drain for about 1 hour (guide value). Deliming may be combined with the curing salt treatment.

The curing step (f) is carried out conventionally by treatment with common salt. As a rule, 20±8 percent by weight of common salt (based on the green weight of the hides) is used for the cure. Curing can be carried out with a relatively short float, a guide value being about 20 percent water, based on the green weight of the hides.

After the salt treatment, the hides or skins are allowed to drain overnight. The next day they can be spread out on pallets in the usual way.

When proper conditions (temperature not over 25° C., relative humidity between 60 and 70 percent) are maintained, the hides or skins can be stored for several months.

The proteolytic activity of the enzymes to be used in the process of the invention is best determined by the so-called Loehlein-Volhard method ("Die Loehlein-Volhard'sche Method zur Bestimmung der proteolytischen Aktivitaet", Gerbereitechnisches Taschenbuch, Dresden-Leipzig, 1955) and expressed in LVU (Loehlein-Volhard units). An LVU is the amount of enzyme which under the specific conditions of the method will digest 1.715 mg of casein.

The products obtained by the process of the invention are novel intermediate products which are now made available to the industry. After brief soaking, these intermediate products can be treated with alkali (hydrated lime, caustic soda, soda) to open the hide structure, as required by the different types of leather, without the use of inorganic sulfides. Since the major portion of the protein load of conventional lime liquors is eliminated in unhairing, the opening of the hide structure with alkali can be carried out by the "recycling" method. No liquors having a high protein or sulfide content that might adversely affect purification of waste waters by biodegradation process are produced.

A better understanding of the present invention and of its many advantages will be had by referring to the following specific examples.

EXAMPLE 1

Unhairing and curing of fresh hides

Raw stock: Freshly flayed bullhides, black and white, weight class 30 to 39½ kg; green weight, 2,000 kg.

Washing (mixer): 50% water, 28° C.,
- Agitate for 15 minutes at 12 rpm;
- pH value of its float, 6.9.
- Drain the float.

Soaking (mixer):
- 50% water, 28° C.,
- 0.3% of an alkaline bacterial proteinase from *Bacillus licheniformis* with 4,000 LVU/g (pH optimum =9-11),
- 0.2% caustic soda solution, 33%.
  - Agitate for 30 minutes at 12 rpm;
  - pH of liquor, 9.6;
  - Specific gravity, 7.2° Bé;
  - Temperature: 27° C.
  - Drain the float.

Unhairing (mixer):
- 50% water, 28° C.,
- 1.0% thioglycolic acid, tech., 85%,
- 4.0% mercaptoethanol,
- 9.0% caustic soda solution, 33%,
- 2.0% hydrated lime.
  - Agitate for 60 minutes at 12 rpm;
  - pH of liquor, 12.5;
  - Verify that hair has been completely removed by drumming.
  - Drain the float.

Washing (mixer): 100% water, 25° C.,
- Agitate for 20 minutes at 12 rpm.
- Drain the float.

Fleshing

Deliming (mixer):
- 100% water, 25° C.,
- 2.0% ammonium sulfate,
- 0.5% sodium hydrosulfite.
  - Agitate for 1 hour.
  - Verify with phenolphthalein solution that alkali is no longer present in a section of the hide.
  - Drain the float.
  - Place the hides on horses and allow them to drain for 1 hour.

Curing (mixer):
- 20% water, 20° C.,
- 20% sodium chloride.
  - Agitate for 1 hour at 12 rpm.

Spread the raw hides out on pallets for one day, then fold them for storage. After storage for 3 months, the cured hides are made into leather.

The unhaired hide stock is completely free of hair and largely free of scud. Because of the short treating time in unhairing, alkalinization of the grain is minimal and is reversed by the deliming which follows. Thus an unhaired hide stock is obtained, the structure of which can be opened with alkalies alone, for example lime and/or caustic soda solution, or soda. The advantage of treating hide stock by this technology is that when alkalies are used to open the hide structure, the protein loading of the effluent is minimized, which is not the case with conventional lime liquors. The liquor may therefore be recycled.

Depending on the way the hide structure is opened, soft, naturally colored shoe upper leathers, upholstery, or clothing leathers can be produced. These are distinguished by pronounced uniformity of color and low specific weight.

EXAMPLE 2

Unhairing and curing of salted skins

Raw stock: Salted calfskins, red and white, weight class 5.0 to 7.5 kg; salted weight, 2,000 kg.

Soaking for dirt removal (drum): 120% water, 28° C.
- Treating time: 1 hour.
- Agitate at 4 rpm for 5 minutes at 10-minute intervals.
- pH of liquor: 6.5.
- Drain the float.

Soaking (drum):
- 120% water, 26° C.,
- 0.25% of an alkaline bacterial proteinase from *Bacillus firmus* with 4,000 LVU/g (pH optimum=9–11),
- 0.25% of a fungal proteinase from *Aspergillus oryzae* with 4,000 LVU/g (pH optimum=9–11),
- 0.1% caustic soda solution, 33%.
- Soaking time: 2 hours.
- 15 minutes agitation alternating with 15 minutes standing.
- pH of liquor, 0.9;
- Specific gravity, 6.8° Bé;
- Temperature, 25° C.
- Drain the float.

Fleshing

Unhairing (drum):
- 50% water, 26° C.,
- 1.0% urea,
- 1.0% thioglycolic acid, tech., 85%,
- 3.0% mercaptoethanol,
- 7.0% caustic soda solution, 33%,
- 1.5% hydrated lime.
- Agitate for 45 minutes at 4 rpm.
- pH of liquor, 13.0.
- Verify that hair has been completely removed by drumming.
- Drain the float.

Washing: 120% water, 25° C.,
- Agitate for 20 minutes at 4 rpm.
- Drain the float.

Deliming:
- 100% water, 25° C.,
- 2.0% ammonium sulfate,
- 0.5% adipic acid.
- Agitate for 1 hour at 4 rpm.
- Verify with phenolphthalein solution that a section of skin is free of lime and that there is no longer any red coloration. Place skins on horses and allow to drain for 1 hour.

Curing (drum):
- 20% water, 20° C.,
- 15% common salt.
- Agitate for 1 hour at 4 rpm.

Spread out the dehaired skin stock on pallets and let drain for one day. Following this, fold the skins for storage. The cured skin stock is fully unhaired and after storage for several months shows no damage induced by bacteria or fungi.

EXAMPLE 3

Enzymatic unhairing and curing of cattlehides

Raw stock: Freshly flayed red and white cattlehides, weight class 25 to 29.5 kg; green weight, 2,000 kg.

Washing (mixer): 50% water, 25° C.
- Agitate for 15 minutes at 12 rpm.
- pH value, 6.8.
- Drain the float.

Soaking (mixer):
- 50% water, 25° C.,
- 0.2% bacterial proteinase from *Bacillus alcalophilus* with 4,000 LVU/g (pH optimum=9–11),
- 0.15% fungal proteinase from *Bacillus mesenthericus* with 4,000 LVU/g (pH optimum=9–11),
- 0.15% trypsin with 4,000 LVU/g,
- 0.1% caustic soda solution, 33%.
- Agitate for 60 minutes at 12 rpm.
- pH of liquor, 8.5.
- Drain the float.

Fleshing

Enzymatic unhairing (mixer):
- 50% water, 30° C.,
- 3.0% alkaline bacterial proteinase from *Bacillus licheniformis* with 8,000 LVU/g (pH optimum=9–11)
- 2.0% hydrated lime.
- Agitate for 3 hours at 12 rpm.

Machine unhairing

Washing (mixer): 50% water, 25° C.
- Agitate for 20 minutes.
- Drain the float.

Deliming (mixer):
- 50% water, 25° C.,
- 1.0% ammonium sulfate,
- 1.0% boric acid.
- Agitate for 1 hour.
- Drain the float.
- Verify that phenolphthalein solution produces no red coloration in a section.
- Place on horses and allow to drain for 1 hour.

Curing (mixer):
- 20% water, 20° C.,
- 25% common salt.
- Rotate at 12 rpm for 1 hour.

Spread out the hides on pallets overnight. The next day, fold them. After storage for four months, no damage due to fungi or bacteria is evident.

What is claimed is:

1. A process for producing unhaired skins and hides, free of opening of the hide structure, as intermediate products storable for an extended time period prior to subsequent treatment to open the hide structure and to make the skins and hides suitable for subsequent tanning, which process comprises washing flayed skins and hides to remove adhering dirt, soaking said skins and hides, freeing said skins and hides of hair and scud with a short term unhairing carried out in the alkaline pH region for ½ hour to 6 hours with little or no opening of the hide structure, reversing the swelling of said skins and hides and neutralizing them to interrupt whatever opening of the hide structure has occurred, and then curing said skins and hides with salt under neutral conditions to produce said storable intermediate products, said skins and hides being mechanically fleshed either after washing or at some later time in the process as recited.

2. A process as in claim 1 wherein said short term unhairing is carried out with a proteolytic enzyme active in the alkaline pH region.

3. A process as in claim 1 wherein said alkaline pH is from 10 to 13.

4. A process as in claim 1 wherein said short term unhairing is carried out in the presence of an organic agent capable of cleaving disulfide bonds.

5. A process as in claim 4 wherein organic agent contains sulfur or nitrogen.

6. A process as in claim 4 wherein said organic agent is used in an amount ranging from 3 to 10 percent by weight of the hides and skins.

7. A process as in claim 1 which is practiced in the absence of an inorganic sulfide.

8. A process as in claim 1 wherein said soaking is carried out for not less than 60 minutes and for not more than 120 minutes.

9. A process as in claim 8 wherein a proteolytic enzyme is present as a soaking aid.

10. A process as in claim 9 wherein said proteolytic enzyme is optimally active in the pH range from 9 to 11.

11. A process as in claim 8 wherein a soaking aid is present in an amount from 0.1 to 0.5 percent by weight of the hides and skins being treated and imparts a pH value of from 7 to 11 to the float employed.

12. A process as in claim 1 wherein a salt having a buffer action in the acid region is used either alone or in combination with an acid for the reversal of swelling.

13. A process as in claim 1 wherein, after reversal of swelling, the dehaired hide stock is cured by drumming with from 12 to 20 percent of common salt by weight of the hide stock being treated.

14. A process as in claim 1 wherein the total length of the floats employed in the process is from 300 to 400 percent by weight of the hide stock being treated.

* * * * *